United States Patent [19]

Udagawa

[11] Patent Number: 4,967,467

[45] Date of Patent: Nov. 6, 1990

[54] METHOD OF MANUFACTURING A PUSHBUTTON ASSEMBLY FOR A SWITCH

[75] Inventor: Yoji Udagawa, Sanda, Japan

[73] Assignee: Mitsubishi Denki Kabushiki Kaisha, Tokyo, Japan

[21] Appl. No.: 344,373

[22] Filed: Apr. 28, 1989

[30] Foreign Application Priority Data

May 31, 1988 [JP] Japan ..... 63-71027[U]

[51] Int. Cl.[5] ..... H01H 11/00

[52] U.S. Cl. ..... 29/622; 200/343

[58] Field of Search ..... 200/343, 341, 345, 5 A; 29/622; 425/292; 264/138, 154; 249/52

[56] References Cited

U.S. PATENT DOCUMENTS

| | | | |
|---|---|---|---|
| 4,032,729 | 6/1977 | Koistinen | 200/5 A |
| 4,055,734 | 10/1977 | Hayden | 200/5 A |
| 4,128,744 | 12/1978 | Seeger | 200/5 A |
| 4,136,270 | 1/1979 | Wernet et al. | 200/343 |
| 4,190,748 | 2/1980 | Langford | 200/5 A |
| 4,323,740 | 4/1982 | Balash | 200/5 A |
| 4,430,531 | 2/1984 | Wright | 200/5 A |
| 4,582,967 | 4/1986 | Brumit et al. | 200/343 |
| 4,613,736 | 9/1986 | Schichijo et al. | 200/343 |
| 4,613,853 | 9/1986 | Hosogoe et al. | 200/343 |

FOREIGN PATENT DOCUMENTS 62-111144 7/1987 Japan .

*Primary Examiner*—Henry J. Recla
*Assistant Examiner*—Keith Kupferschmid
*Attorney, Agent, or Firm*—Burns, Doane, Swecker & Mathis

[57] ABSTRACT

A method of manufacturing a pushbutton assembly includes the steps of integrally forming a plastic panel, a plastic hinge, and a plastic holder for holding a pushbutton such that at least one connecting member connects a stopper of the holder and a receiver of the panel, forming a pushbutton, fitting the pushbutton to the holder by hooks, and separating the stopper and the receiver by severing the connecting member.

2 Claims, 4 Drawing Sheets

METHOD OF MANUFACTURING A PUSHBUTTON ASSEMBLY FOR A SWITCH

FIELD OF THE INVENTION AND RELATED ART STATEMENT

1. Field of the Invention

The present invention relates to a pushbutton assembly for operation of a pushbutton switch or the like which is to be used, for example, in electric apparatus, electronic apparatus, audio apparatus, visual apparatus, etc.

2. Description of the Related Art

FIG. 6 and FIG. 7 show a pushbutton assembly which has been used conventionally. In FIG. 6 and FIG. 7, a holder 3 is fixed to a panel 1 by melting a pin- or rod-shaped members 1',1' of the panel 1, which are inserted through holes 5,5 of the holder 3. A pushbutton 2 is fitted to the holder 3 by hooks 4,4a of the pushbutton 2. As a point of the hook 4a comes in contact with a pushbutton switch 7, the pushbutton switch 7 is pressed to operate when the pushbutton 2 is pressed by a finger 10. And, at the time, since the holder 3 is connected to the panel 1 via hinges 6,6 on one side (upper side in FIG. 6) of the holder 3, the holder 3 and the pushbutton 2 fitted thereto are rotated to a limited extent around the hinges 6,6. Further, the holder 3 comprises a stopper 8 on the other side (lower side in FIG. 6) of the holder 3. The panel 1 comprises a receiver 9 so as to receive the stopper 8 in normal position. Thus, the holder 3 is prevented to come through the panel 1 (leftwards in FIG. 6 and FIG. 7).

The operation of the above-mentioned pushbutton assembly is as follows.

When the pushbutton 2 is pressed by finger 10, it is rotated by a small angle by bending of the hinges 6,6 of the holder 3. And, the hook 4a of the pushbutton 2 pushes the pushbutton switch 7 to turn it on.

After the above-mentioned state, the holder 3 returns by restoring force in the hinges 6,6 when finger 10 parts from the pushbutton 2. And, the pushbutton 2 returns to the first position where the stopper 8 of the holder 3 is stopped to touch to the receiver 9 of the panel 1.

In the above-mentioned conventional pushbutton assembly for operation of a pushbutton switch, the panel 1 and the holder 3 having the hinges 6,6 have been manufactured separately, and thereafter, these components are each-other fixed and assembled together by melting of the pins 1',1' or other methods. Since the conventional device has many components, the assembling of it requires many working steps in manufacturing. For that reason, the conventional device has been expensive to produce. Further, in the state before fitting the pushbutton 2 to the holder 3, if external force is given to the holder 3 for a long time from the direction of pressing the pushbutton 2, the hinges 6,6 of the holder 3 become deformed in shape, so that the restoring force of the hinges 6,6 is lost. Thus, the life of the hinges 6,6 decreases.

That is, the above-mentioned conventional pushbutton assembly has many problems that must be solved.

OBJECT AND SUMMARY OF THE INVENTION

It is an object of the present invention to provide a pushbutton assembly for switch which has longer and stable life with less components, and is manufactured by less working steps, compared with the conventional one.

Another object of the invention is to provide a pushbutton assembly having hinges which do not become deformed of shape before or at the final step of the assembly of the device.

A pushbutton assembly for switch of the present invention comprises:

a plastic panel covering at least a switching device in an electrical apparatus and having an aperture adjacent to an actuation member of the switch device;

at least one plastic hinge which is formed integral with the plastic panel and connected to the plastic panel at the part adjacent to the aperture and having flexibility;

a plastic holder which is formed inside the aperture, has at least one stopper for abutting a part of the plastic panel for defining a resting position thereof in relation to the plastic panel and is formed integral with the plastic panel and the plastic hinge, thereby the plastic holder being connected to the plastic panel via the plastic hinge; and a pushbutton fitting in the plastic holder for abutting an actuation member of the switch device.

Accordingly, the panel, the holder, the hinge and the stopper are formed integrally by molding. For a reason, a pushbutton assembly of the present invention comprises less components, and thereby number of working steps necessary for assembling is smaller than the conventional ones, and the conventional melting step for fixing the holder and the panel and so on are eliminated.

Furthermore, as the stopper and the receiver are kept in the connected state until the final step of the assembly of the device, the hinge is kept normal shape until time to be separated in the final step in the assembly. Thus, if the hinge receives some external force in various steps in the manufacture, such as, painting or printing on the panel, transportation, handling, etc., the hinge is not deformed. Accordingly, the pushbutton assembly is assembled with the hinge having accurate restoring force and excluding deformation of shape, thereby to achieve a long service life and high manufacture yield rate.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the figures are schematic representations for purposes of illustration and do not necessarily depict the actual relative sizes or locations of the elements shown.

DESCRIPTION OF THE PREFERRED EMBODIMENT

Figure 6:
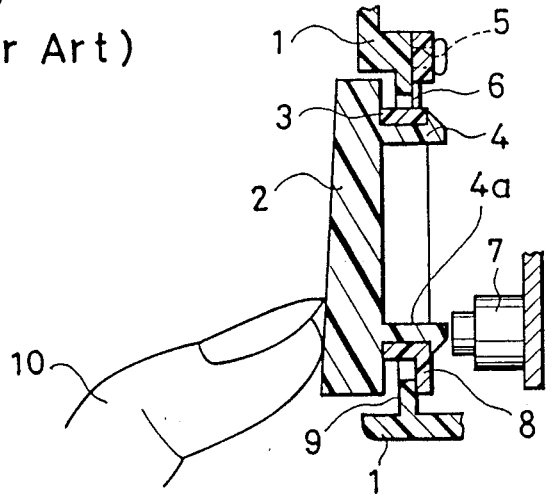
FIG. 6 (Prior Art)
FIG. 6 is the sectional view of the conventional pushbutton assembly.
Figure 7:
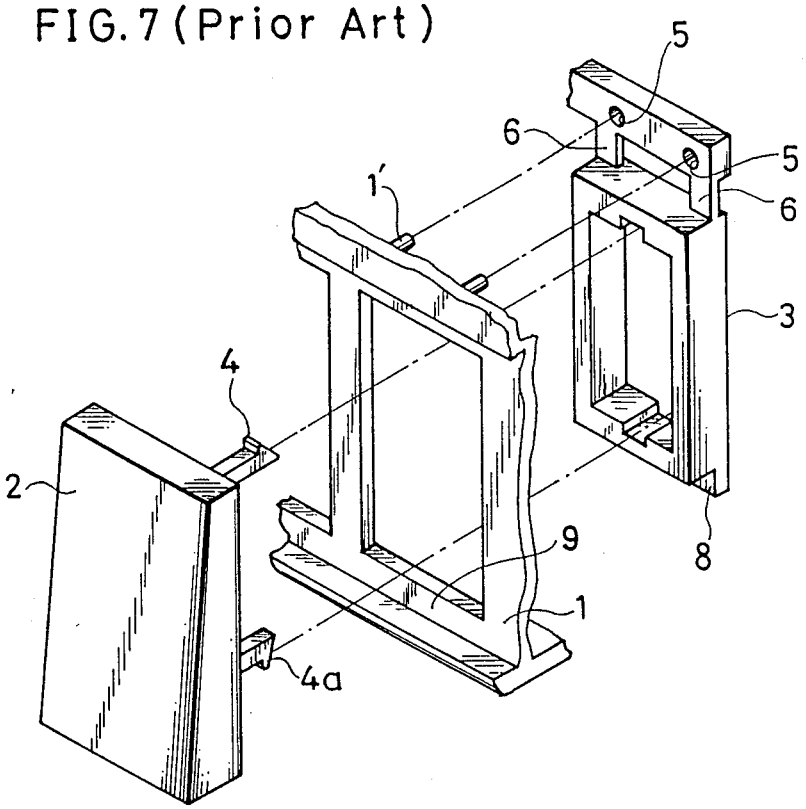
FIG. 7 (Prior Art)
FIG. 7 is the exploded perspective view of the pushbutton assembly of FIG. 6.

FIGS. 1 to 4B show a preferred embodiment of the invention. In the drawings, hooks 4,4*a* of a pushbutton 2 and a pushbutton switch 7 are similar components to what is shown in FIGS. 6 and 7, and the same description apply.

Figure 1:
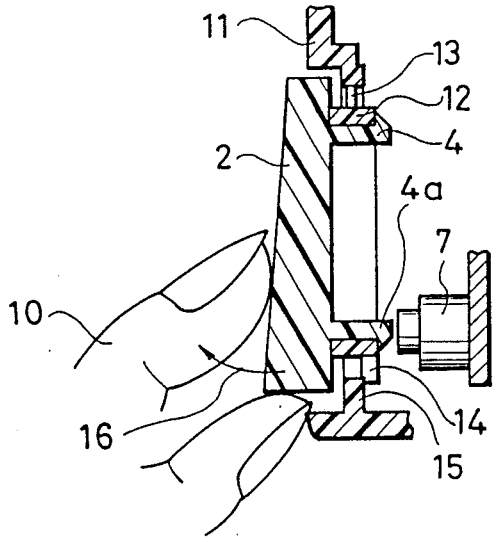
FIG. 1 is a sectional view of a pushbutton assembly for a switch, embodying the present invention.
Figure 2:
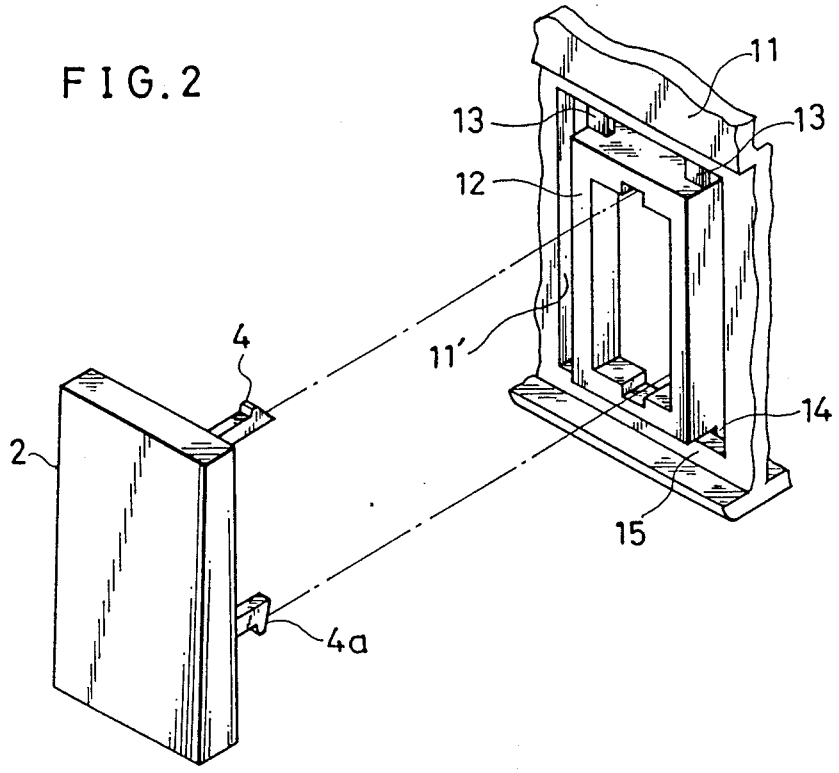
FIG. 2 is an exploded perspective view of a pushbutton assembly of FIG. 1.
Figure 3:
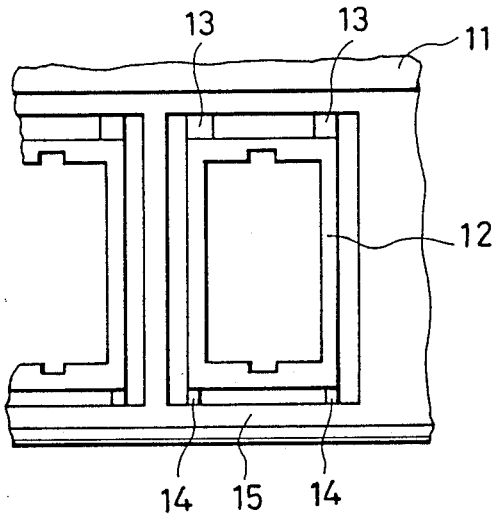
FIG. 3 is an elevational view of a main component in FIG. 1.

In FIG. 1 to FIG. 3, a panel 11 is connected to a holder 12 via hinges 13,13 inside an aperture 11' of the panel 11, which is formed integrally. Since, hinges 13,13 have resiliency of the plastic material, for example ABS resin, the pushbutton 2 can be rotated with the holder 12 by the hinges 13,13 to be bent. Two stoppers 14,14 having stop surfaces thereon are provided to project from the lower side of the holder 12, and a receiver 15 having a receiving surface thereon is provided on the lower side of the panel 11 so as to contact the stoppers 14,14 for prevention of undue protruding of the holder 12 leftward in FIGS. 1 and 2 from the panel 11. The stoppers 14,14 and the receiver 15 are molded integrally with the holder 12 and with the panel 11, respectively, in the manufacturing step. Thereafter, each stoppers 14,14 and receivers 15 are separated from each other in the assembly step. And the separated stoppers 14,14 prevent undue protruding of the holder 12 with the pushbutton 2 to the opposite direction of pressing by finger 10 as shown an arrow 16, by contacting of the stoppers 14,14 with the receiver 15. Thus, each stopper 14,14 and receiver 15 is arranged on the lower holder 12, and the hinges 13,13 are arranged on the upper holder 12.

Operation of the pushbutton assembly of the above-mentioned embodiment is as follows. In the assembly step, the stoppers 14,14 and the receiver 15 which have been formed integral by molding and have contacted each other at contacted portions 14',14' as shown in FIG. 4B, will be separated at the contacted portions 14',14' to be able to move the stoppers 14,14.

In the operation of the pushbutton switch 7, when the pushbutton 2 is pressed by finger 10, the push-button 2 moves together with the holder 12 by bending of the hinges 13,13 parting the stoppers 14,14 a little from the receiver 15. And a part of the hook 4*a* of the push-button 2 is pressed to turn it on.

When the finger 10 parts from the pushbutton 2, the holder 12 with pushbutton 2 thereon returns by restoring force of the hinges 13,13. Thereafter, the stoppers 14,14 touch the receiver 15 to stop the holder 12 with the pushbutton 2 at a first position.

Figure 4A:
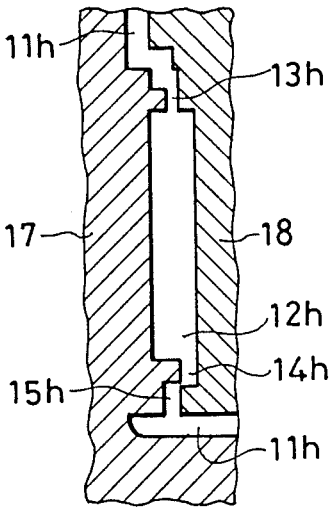
FIG. 4A is a sectional view of a mold form for molding a main component in FIG. 3.
Figure 4B:
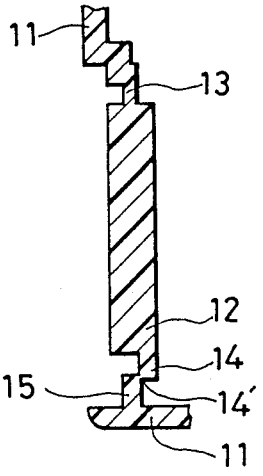
FIG. 4B is a sectional view of a main component molded by the mold form of FIG. 4A.

FIG. 4A shows a molded integral block which comprises a stationary block 17 and a movable block 18, and which has recesses of the panel 11*h*, the holder 12*h*, the hinges 13*h*,13*h*, the stoppers 14*h*,14*h*, and the receiver 15*h*. The stoppers 14,14 and the receiver 15 are molded in the state to be contacted each other at the contacted portions 14'14' which are approximately 0.2 mm width each to be able to separate them. FIG. 4B is a sectional view of a pushbutton assembly molded by the mold form of FIG. 4A. The receiver 15 is contacted to the stoppers 14,14 as shown in FIG. 4B.

Figure 5:
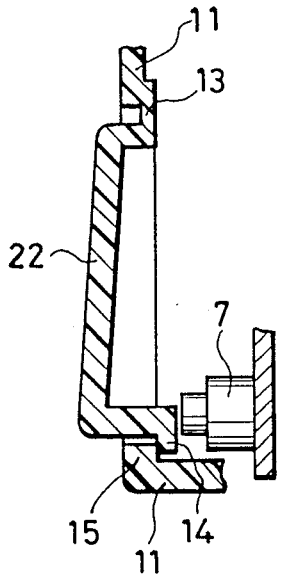
FIG. 5 is a sectional view of a pushbutton assembly for switch as another embodiment of the present invention.

In the above-mentioned embodiment, the pushbutton 2 and the holder 12 are formed separately. However, FIG. 5 shows another preferred embodiment of the present invention in which a pushbutton 22 and a holder 12 are formed integrally. Thus, a panel 11 and a hinge 13 and the pushbutton 22 are formed integrally by molding. For the reason, this pushbutton assembly of the present invention comprises less components further. And a stop surface on stopper 14 of the pushbutton 22 and a receiving surface on receiver 15 of the panel 11 are molded in the state to be contacted each other. Thereafter, the stopper 14 and the receiver 15 are separated from each other in the assembly step such that said pushbutton 22 pivots about hinge 13 and said stop surface abuts said receiving surface in a first position. Accordingly, same effect is given like the aforementioned embodiment.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A method of manufacturing a pushbutton assembly for a switch, comprising the steps of:

(a) integrally forming a plastic holder having a stopper defining a stop surface thereon, a plastic panel having a receiver defining a receiving surface thereon, and a plastic hinge in one piece such that said hinge pivotally connects said holder to said panel at a location therebetween and said stop surface is connected to said receiving surface at a location remote from said hinge;

(b) forming a pushbutton;

(c) fitting said pushbutton to said holder by means of hooks; and (d) severing said stop surface from said receiving surface whereby, in operation said holder pivots about said hinge and said stop surface abuts said receiving surface in a first position.

2. A method of manufacturing a pushbutton assembly for a switch, comprising the steps of:

(a) integrally forming a plastic pushbutton, a plastic holder having a stopper defining a stop surface thereon, a plastic panel having a receiver defining a receiving surface thereon, and a plastic hinge in one piece such that said hinge pivotally connects said holder to said panel at a location therebetween and said stop surface is connected to said receiving surface at a location remote from said hinge;

(b) severing said stop surface from said receiving surface whereby, in operation said holder pivots about said hinge and said stop surface abuts said receiving surface in a first position.

* * * * *